US005979414A

United States Patent [19]

Pugh

[11] Patent Number: 5,979,414

[45] Date of Patent: Nov. 9, 1999

[54] FUEL METERING PUMP FOR INTERNAL COMBUSTION ENGINE

[75] Inventor: Jason Pugh, Fond du Lac, Wis.

[73] Assignee: Brunswick Corporation, Lake Forest, Ill.

[21] Appl. No.: 08/883,210

[22] Filed: Jun. 26, 1997

[51] Int. Cl.[6] ..... F02M 37/04

[52] U.S. Cl. ..... 123/504; 123/372; 123/369

[58] Field of Search ..... 123/516, 504, 123/357, 369, 372, 373

[56] References Cited

U.S. PATENT DOCUMENTS

| | | | |
|---|---|---|---|
| 3,146,770 | 9/1964 | Garcea | 123/369 |
| 3,718,123 | 2/1973 | Eckert | 123/357 |
| 4,811,709 | 3/1989 | Braun | 123/357 |
| 4,909,226 | 3/1990 | Nakahama | 123/516 |
| 5,735,250 | 4/1998 | Rembold | 123/504 |

FOREIGN PATENT DOCUMENTS

| | | | |
|---|---|---|---|
| 813766 | 5/1959 | United Kingdom | 123/504 |
| 2054060 | 2/1981 | United Kingdom | 123/504 |

*Primary Examiner*—Carl S. Miller

*Attorney, Agent, or Firm*—Andrus, Sceales, Starke & Sawall

[57] ABSTRACT

A fuel metering pump assembly for delivering fuel to a combustion chamber of an internal combustion engine has a crankcase, a throttle and at least one cylinder. A housing has a fuel inlet and a fuel outlet, and a metering arrangement is disposed in the housing between the fuel inlet and the fuel outlet. The metering arrangement has a plunger rod movable in a chamber between the fuel inlet and the fuel outlet to control the flow of fuel therefrom, and a movable camshaft is engageable with the plunger rod to selectively deliver fuel from the fuel outlet at a predetermined pressure and volume in response to pulses from the crankcase. A motive device is mounted on the housing in direct engagement with the camshaft. The motive device is responsive to the position of the throttle to move the camshaft relative to the plunger rod so as to vary the fuel delivered from the fuel inlet to the fuel outlet.

1 Claim, 5 Drawing Sheets

FIG. 6
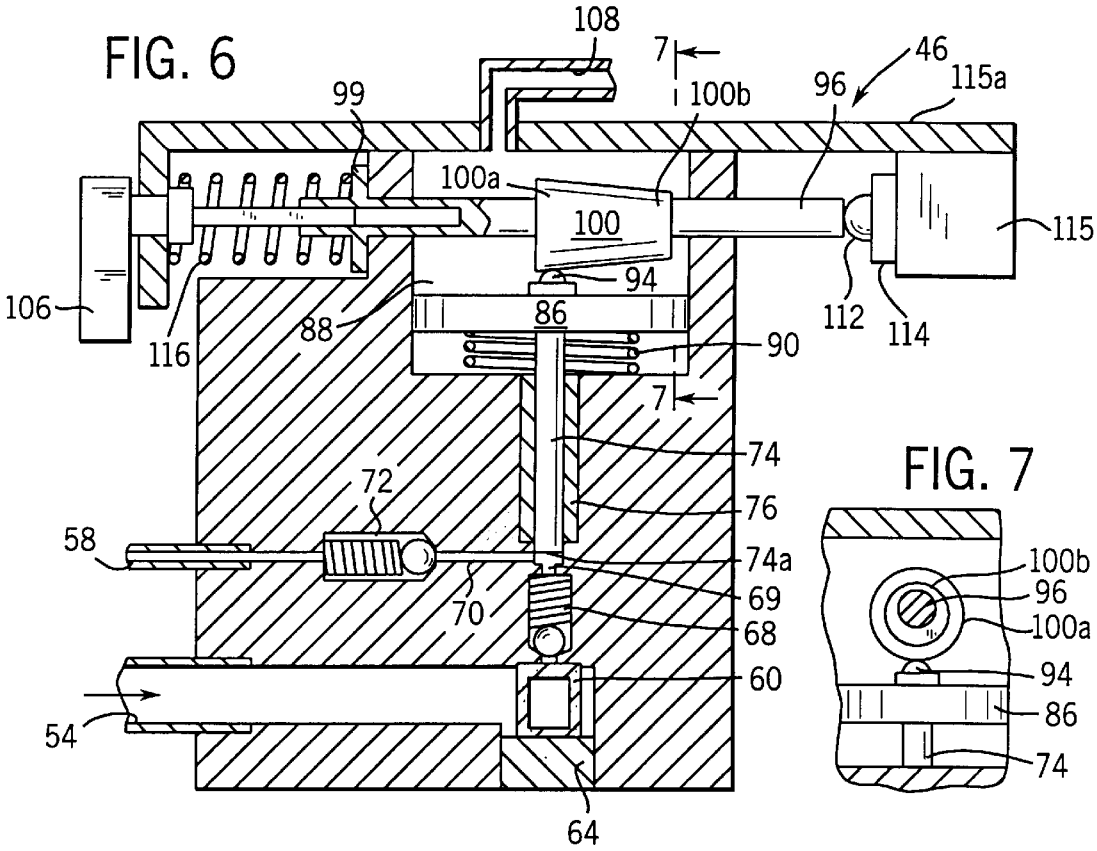
FIG. 7
FIG. 8
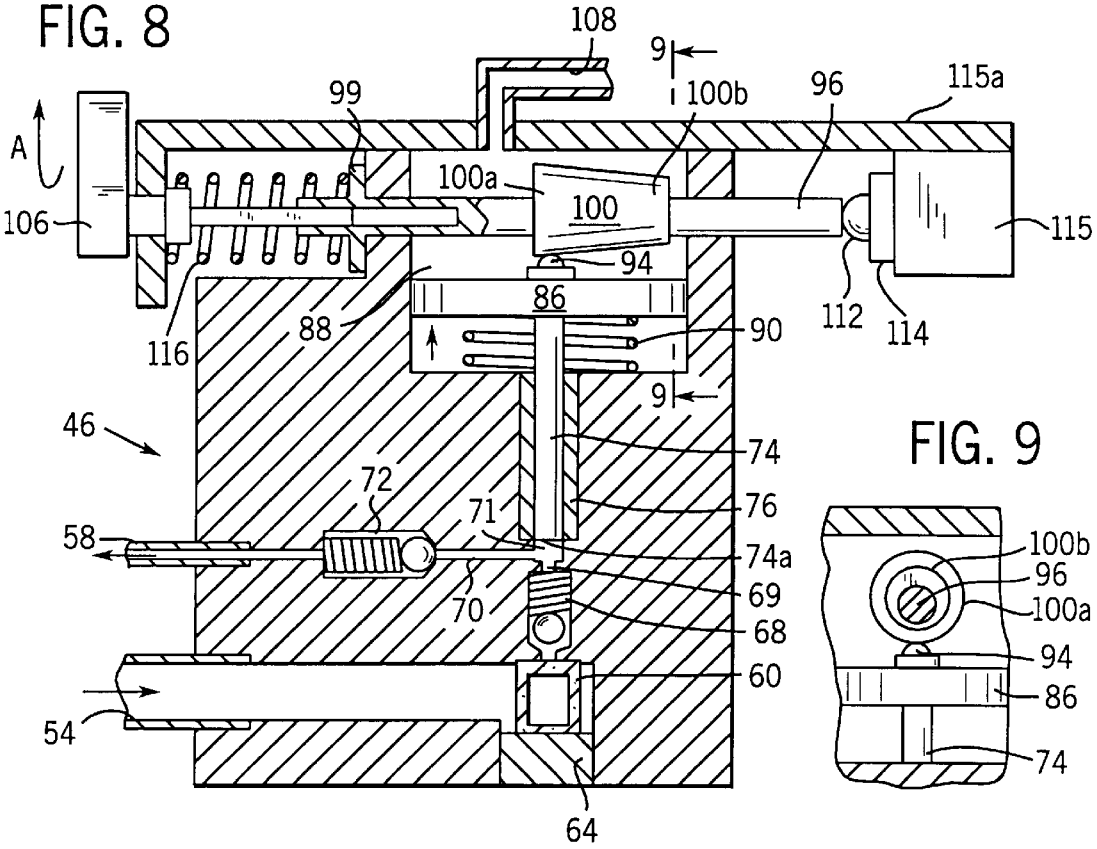
FIG. 9

FIG. 10
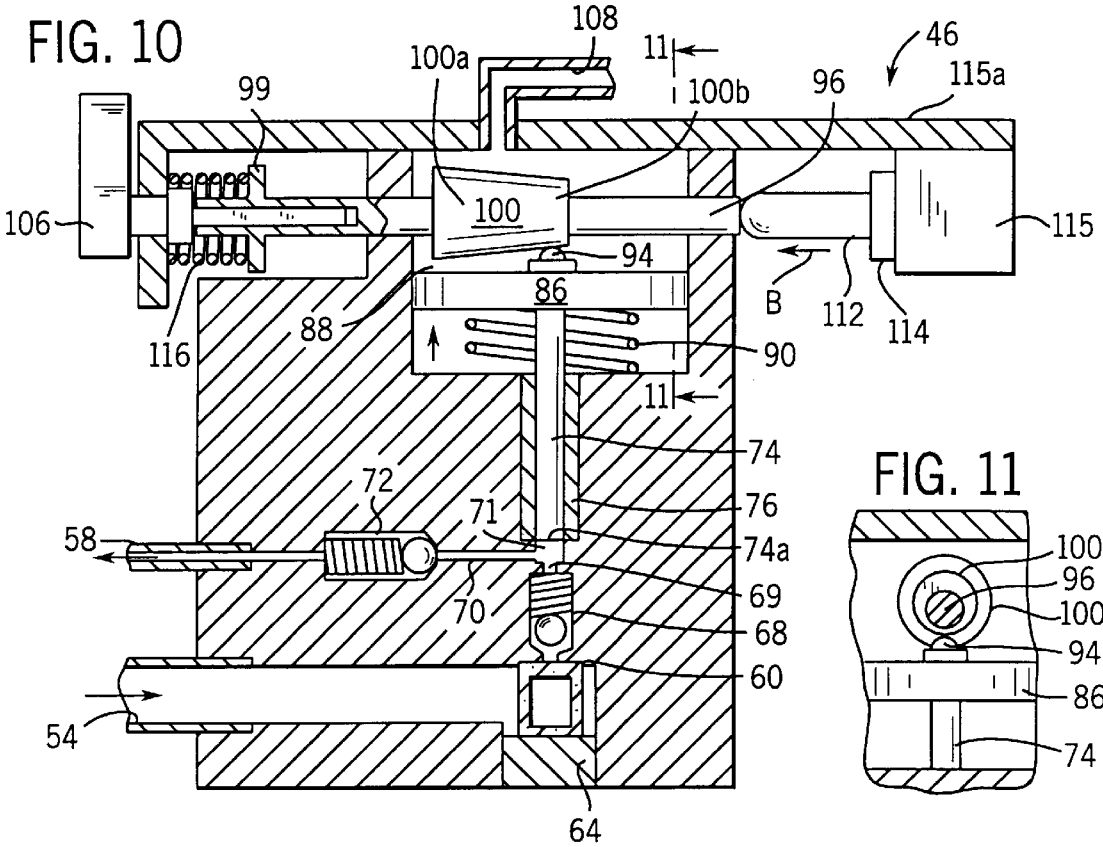
FIG. 11
FIG. 12
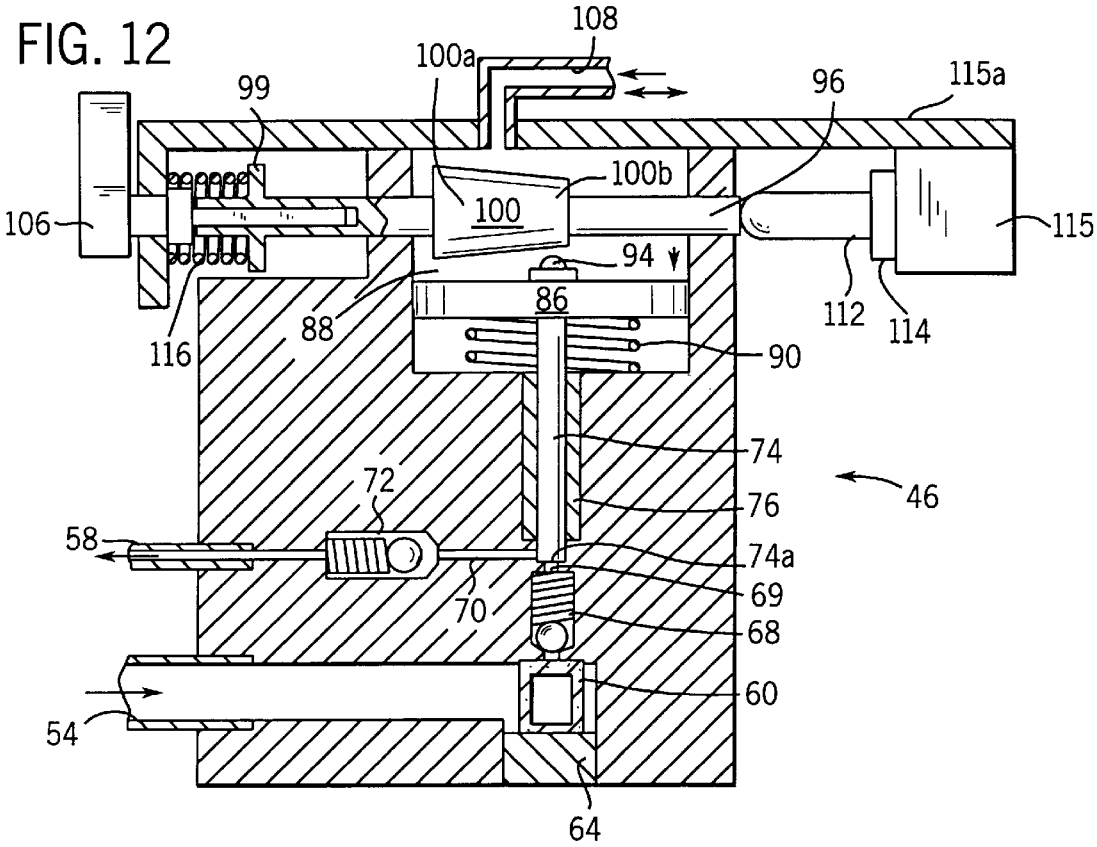

FUEL METERING PUMP FOR INTERNAL COMBUSTION ENGINE

BACKGROUND OF THE INVENTION

This invention relates broadly to mechanical fuel metering in fuel injected, internal combustion engines and, more particularly, pertains to an improved fuel metering pump which delivers a desired amount of fuel at a predetermined time and pressure.

Fuel metering pumps are mechanical supply devices used in conjunction with fuel injected internal combustion engines to increase fuel pressure for delivery to a direct fuel injector, and to meter an appropriate amount of fuel for each cycle of each cylinder in the engine. The fuel metering pump employs an internal piston which forces a smaller piston or plunger rod attached to it back and forth by using crankcase pulses existing in every two-stroke engine. The plunger rod expels fuel at a high-pressure which is achieved through the pressure area differential of the internal piston and the plunger rod. This fuel is delivered through a small diameter, high-pressure line to the direct fuel injector in the combustion chamber of the engine. Since the engine requires different fueling levels for different speed and load conditions, the stroke of the plunger rod must be adjustable. The correct quantity of fuel is determined by a small displacement of the plunger rod which results in injection at once per cycle. The amount of fuel injected at each cycle is controlled by varying the stroke of the plunger rod. This reciprocal motion is achieved through the engagement of a concentric button cam on the top of each plunger rod with a cam mounted for rotation on a camshaft which is connected to the external linkage of the throttle to receive driver demand. For each cylinder in the engine, there is a corresponding plunger rod and cam. The fuel metering pump utilizes a conventional stepper motor to act on the throttle linkage for start-up and idle control. A stepper motor is an electronically controlled, motive device that has its own plunger that can be moved in and out an incremental amount in response to the engine control module (ECM). The ECM receives signals from various engine sensors and changes fuel volume by sending a signal to the stepper motor so as to rotate the camshaft and its cam relative to the respective button cam on the top of each plunger rod. Rotating the cam against a strong throttle return spring limits the stroke that the plunger rod can move thereby limiting fuel quantity which is ultimately delivered at a high-pressure into an air space in the direct fuel injector. Here the fuel is mixed and starts to vaporize with air after which the fuel-air mixture is ignited in the combustion chamber.

While the fuel metering pump described above has been generally satisfactory at providing a stable idle that can maintain a set speed with a variable load, this design has been found to have several drawbacks. For example, it has been determined that the overall fuel requirements for an engine did not match the linear delivery characteristics of the metering pump. The engine required more fuel at acceleration and in mid-range speeds when a high load was placed on the engine than it required at wide open throttle. Also, stepper motor response and reliability were inadequate with the stepper motor mounted directly on the throttle linkage. Further, the stepper motor mounting used in the current fuel metering pumps subjects the stepper motor to dirt and corrosion which decreases the reliability and durability of the device.

Accordingly, it is desirable to provide a fuel metering pump which will deliver the proper quantity and pressure of fuel to the combustion chamber of a fuel injected, internal combustion engine at starting, idle and rapid acceleration or high load situations. It is also desirable to provide a fuel metering pump having a faster acting, more responsive stepper motor which allows for trimming the fuel level to the exact requirements for any throttle position. It is further desirable to provide a fuel metering pump having a cleaned sealed environment for the stepper motor to operate. It remains desirable to provide a fuel metering pump which permits simplification of the throttle linkage reducing cost, complexity and associated wear/service problems.

BRIEF SUMMARY OF THE INVENTION

The present invention advantageously provides a fuel metering pump wherein mechanical fuel pump metering for fuel injected internal combustion engines can be managed for improved idle stability and enrichment of fuel mixture for quick starting and rapid acceleration or high load conditions.

In one aspect of the invention, a fuel metering pump assembly for delivering fuel to a combustion chamber of an internal combustion engine has a crankcase, a throttle and at least one cylinder. The assembly includes a housing having a fuel inlet and a fuel outlet. A metering arrangement is disposed in the housing between the fuel inlet and the fuel outlet and has a plunger rod movable between the fuel inlet and the fuel outlet to control the flow of fuel therefrom. A movable camshaft is engageable with the plunger rod to selectively deliver fuel from the fuel outlet at a predetermined pressure and volume in response to pulses from the crankcase. A motive device is mounted on the housing in direct engagement with the camshaft. The motive device is responsive to the position of the throttle to move the camshaft relative to the plunger rod so as to vary the fuel delivered from the fuel inlet to the fuel outlet. The motive device is preferably a stepper motor which has a longitudinal axis which is coaxial with the longitudinal axis of the camshaft. The metering arrangement further includes a linkage connecting the throttle and the camshaft. The engine further includes a throttle position sensor mounted in the vicinity of the throttle, a fuel injector attached to the crankcase and an electronic control device for controlling the throttle position sensor and fuel injector. The electronic control device is responsive to the throttle position sensor and is connected to the motive device. The fuel outlet is connected to the fuel injector, and the fuel inlet and the fuel outlet are both provided with check valves. The metering arrangement includes a piston secured to the plunger rod, the piston having a greater surface area exposed to the crankcase pulses than the plunger rod. The metering arrangement further includes a bushing within which the piston slides. A return line communicates any excess fuel flowing from the fuel inlet and between the plunger rod and the bushing to a vapor separator.

In another aspect of the invention there is contemplated a fuel metering pump assembly for delivering fuel to an internal combustion engine having a crankcase, a throttle and at least one cylinder. The fuel metering pump assembly includes a housing having a fuel inlet and a fuel outlet, a metering arrangement disposed in the housing and having a button cam on one end of a plunger rod movable over a variable stroke between the fuel inlet and the fuel outlet and a movable camshaft having a cam rotatable against the button cam on the plunger rod to selectively vary the stroke thereto and deliver fuel from the fuel outlet at a predetermined pressure and volume responsive to pulses in the crankcase. The improvement resides in the cam being tapered in the direction of a longitudinal axis of the camshaft. In addition, a motive device is mounted on the housing and has an axially movable plunger positioned against one end of the camshaft for selectively sliding the camshaft and its tapered cam against the button cam on the plunger rod in response to the position of the throttle so as to further vary the stroke of the plunger rod and the fueling level for the cylinder. The cam is preferably frustoconically shaped. A biasing device is located in the housing opposite the motive device for constantly urging the one end of the camshaft against the plunger. A throttle lever links the camshaft with the throttle on a side of the housing opposite the motive device. A throttle position indicator is mounted on the camshaft between the housing and the throttle lever. The plunger of the motive device is movable back and forth in a linear manner.

In yet another aspect of the invention, a fuel metering pump assembly for delivering fuel to an internal combustion engine having a crankcase and a throttle includes a housing having a fuel inlet and a fuel outlet. A metering arrangement is disposed in the housing and has a plunger rod movable over a variable stroke between the fuel inlet and the fuel outlet, and a movable camshaft having a cam rotatable against the plunger rod to selectively vary the stroke thereof to deliver fuel from the fuel outlet at a predetermined pressure and volume. The improvement resides in the cam being rotatable about and slidable along a longitudinal axis of the camshaft against the plunger rod in response to pulses in the crankcase and the position of the throttle to vary the stroke of the plunger rod and control the fuel metered from the fuel outlet.

Various other objects, features and advantages of the invention will be made apparent from the following description taken together with the drawings.

BRIEF DESCRIPTION OF THE SEVERAL VIEWS OF THE DRAWING

The drawings illustrate the best mode presently contemplated of carrying out the invention. In the drawings:

FIGS. 6, 8, 10 and 12 are sequential diagrammatic views showing the fuel metering pump in various non-flow and flow conditions; and FIGS. 7, 9 and 11 are fragmentary, sectional views taken on line 7—7 of FIG. 6, line 9—9 of FIG. 8 and line 11—11 of FIG. 10, respectively.

DETAILED DESCRIPTION OF THE INVENTION

Figure 1:
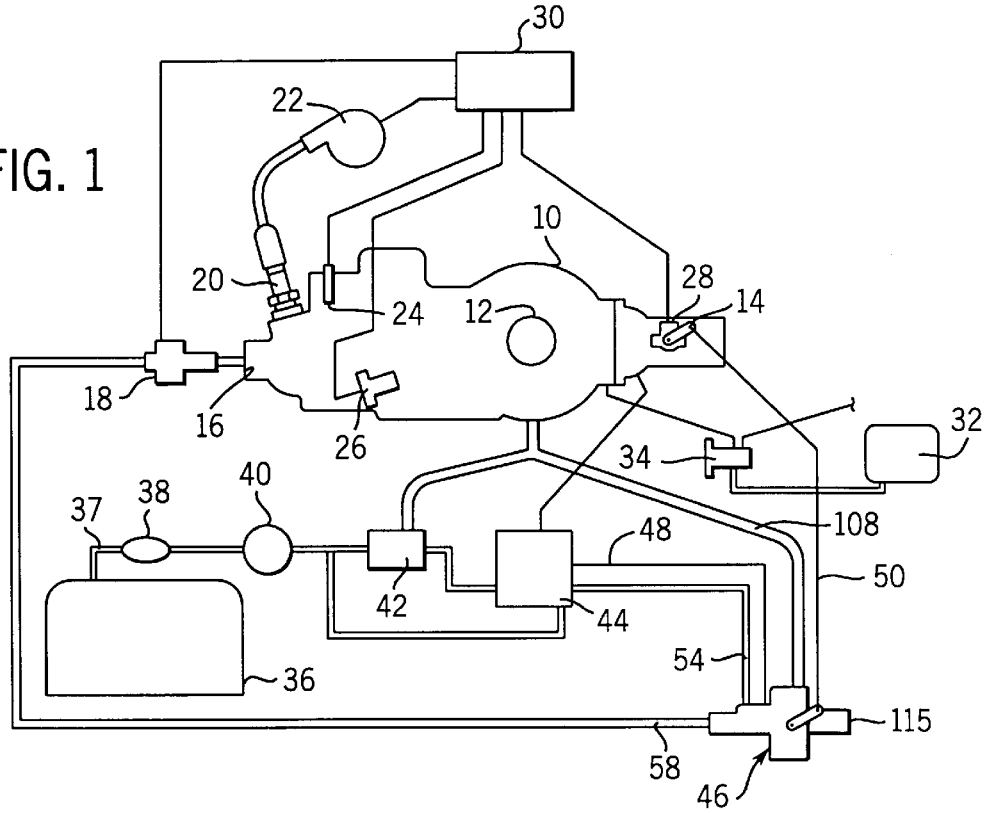
FIG. 1 is a schematic diagram of an operating system for an internal combustion engine employing the fuel metering pump of the present invention.

FIG. 1 schematically shows an operating system for a fuel-injected marine engine having a crankcase 10, a crankshaft 12, a throttle 14 and a combustion chamber 16 which is connected with a direct fuel injector 18. The engine is provided with a spark plug 20 joined to an ignition coil 22, an engine temperature sensor 24, a magnetic pick-up 26 for sensing crank position, a throttle position sensor 28 and a computerized electronic control module (ECM) 30 for managing each of these components. The engine has an oil supply system including an oil tank 32 and a multiple discharge port, mechanically driven oil pump 34 which supplies oil to the crankcase 10 for lubricating bearings, pistons and other moving components of the engine. Although not shown, the engine may be provided with an air compressor which is also lubricated by the oil supply system.

The engine also includes a fuel supply system comprising a fuel tank 36, a primer bulb 38 for priming the tank, and a fuel filter 40 for removing contaminants and water from the fuel. A fuel pump 42 is driven by pulses from the crankcase 10 and draws fuel from the fuel tank 36 through a fuel line 37 and the fuel filter 40 and supplies the fuel to a vapor separator 44. The vapor separator 44 is utilized for removing vaporized fuel from the system and delivering low-pressure fuel (e.g. 10–20 psi) to a fuel metering pump 46 embodying the present invention. The fuel metering pump 46 is connected with the ECM 30 and is also driven by pulses from the crankcase 10 to increase fuel pressure (e.g. to 80+ psi) and deliver a predetermined amount of fuel at this high pressure to the fuel injector 18 for each cycle of each cylinder. Fuel which is not used by the fuel metering pump 46 is returned via a line 48 to the vapor separator 44. A throttle link 50 connects the throttle 14 with the fuel metering pump 46. In the fuel injector 18, the fuel mixes and starts to vaporize with air supplied by the engine's cylinders or air compressor (if provided). The fuel injector 18 is designed to open, discharging the air-fuel mixture into the combustion chamber 16 where it is ignited by the spark plug 20.

Figure 3:
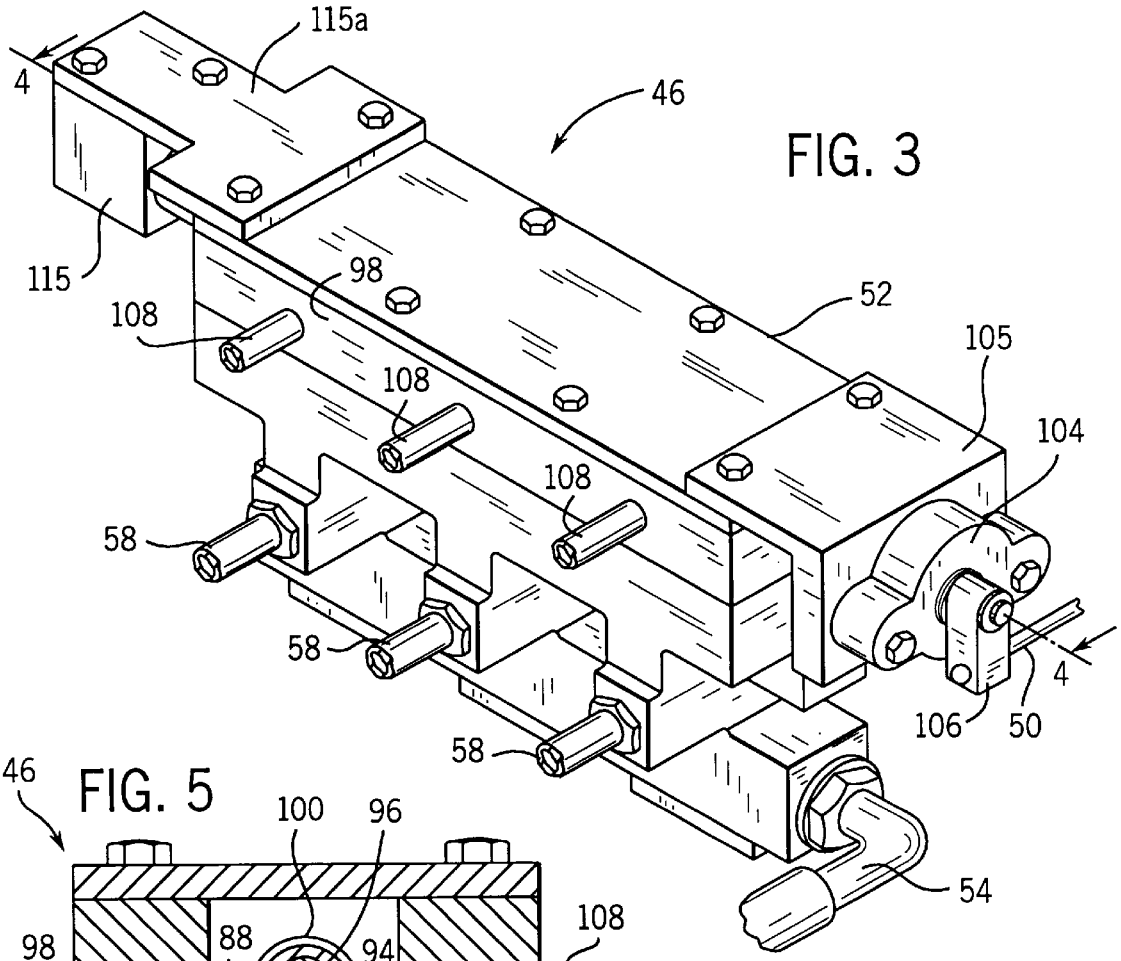
FIG. 3 is a perspective view of the fuel metering pump embodying the present invention.
Figure 5:
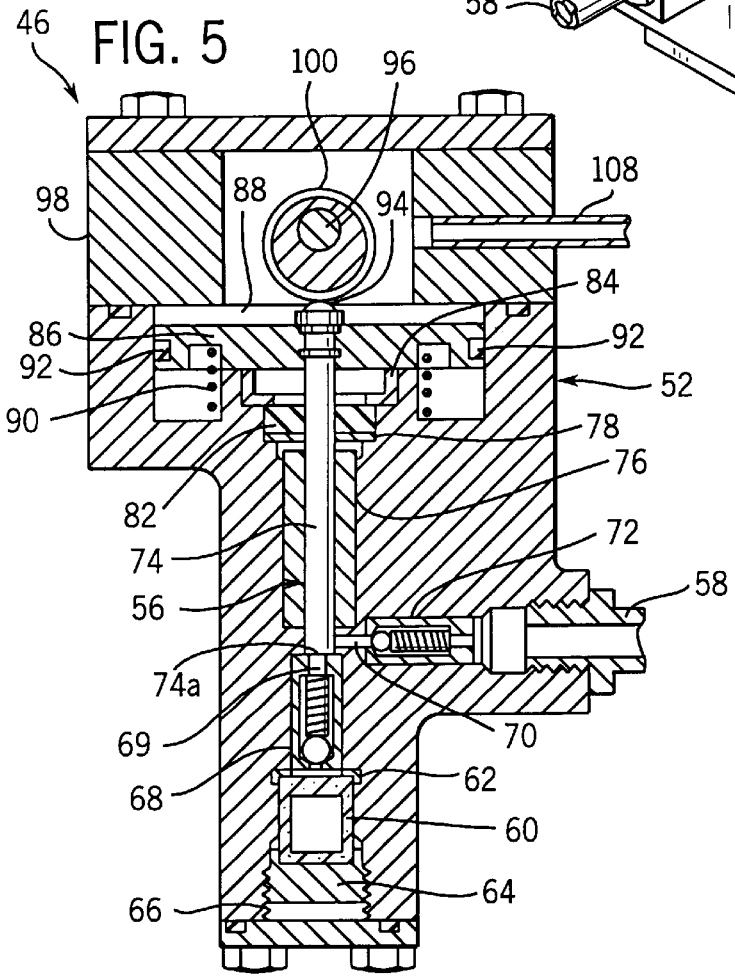
FIG. 5 is a sectional view of the fuel metering pump taken on line 5—5 of FIG. 4.
Figure 4:
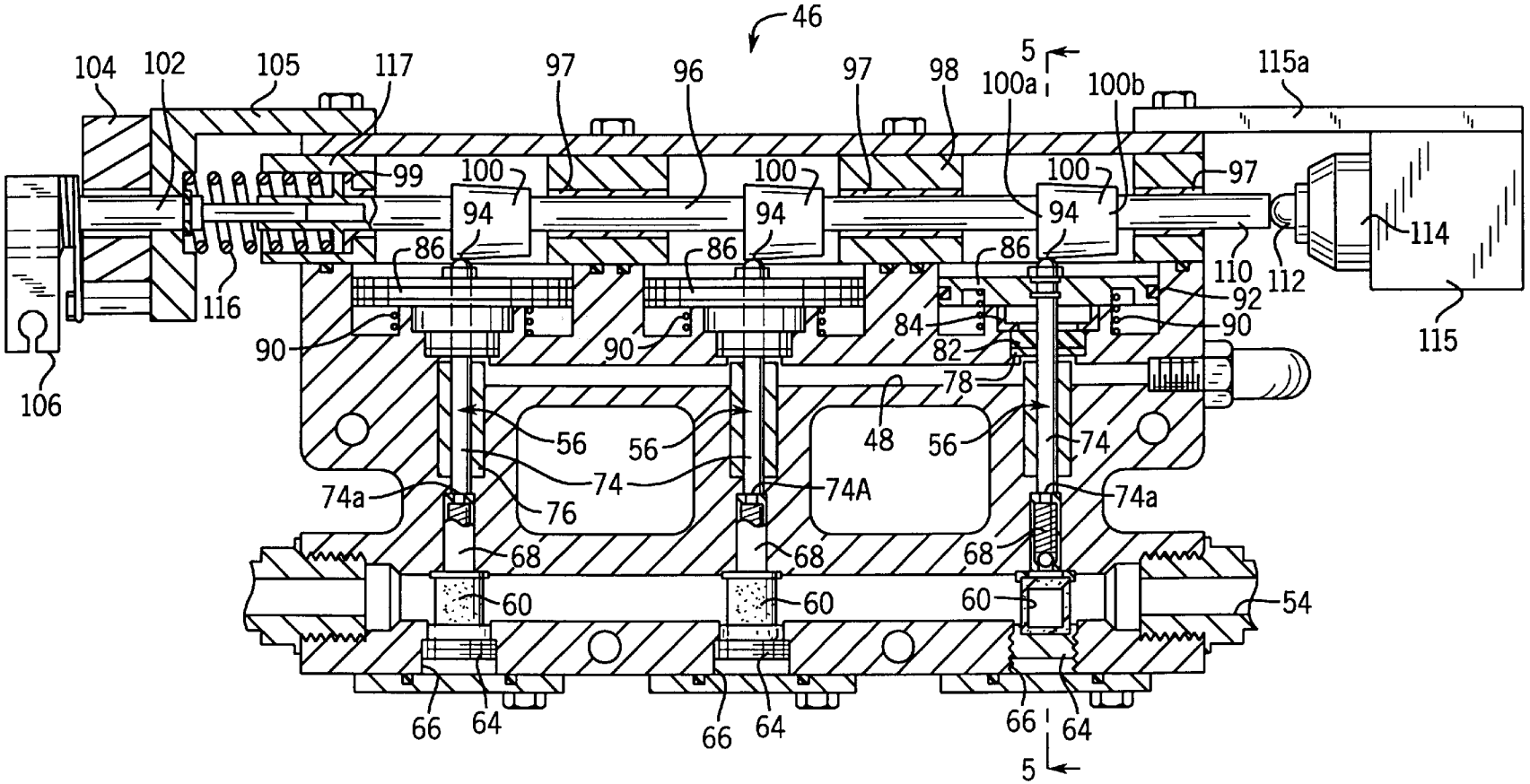
FIG. 4 is a sectional view of the fuel metering pump taken on line 4—4 of FIG. 3.

Referring to FIGS. 3–5, the fuel metering pump 46 includes a housing 52 having a common fuel inlet 54, three identical metering arrangements 56, and a fuel outlet 58 for each metering arrangement 56. In the preferred embodiment, there is shown a fuel metering pump 46 for a three-cylinder engine, but it should be clearly understood that the fuel metering pump 46 is appropriately designed with one metering arrangement 56 and a fuel outlet 58 for each working cylinder in the engine. Fuel delivered into the fuel inlet 54 passes through a fuel filter 60 which is retained in place by a retaining ring 62 at its top portion and a plug 64 along its bottom portion. Each plug 64 is screwthreaded into a passageway 66 formed in and accessible from the bottom of the housing 52. Fuel flowing into the fuel inlet 54 and through the filter 60 and retaining ring 62 travels through an inlet check valve 68 disposed in the housing 52. Each inlet check valve 68 has a narrow inlet 69 and is placed generally at right angles in fluid communication with the fuel outlet 58 which is formed in the housing 52. Each fuel outlet 58 comprises a restricted delivery channel 70, and an outlet check valve 72.

A pumping chamber 71, FIG. 10, is formed between inlet 69 and channel 70, which chamber has a volume controlled by the variable stroke of a cylindrical plunger rod 74 which slides back and forth in a cylindrical bushing 76 fixed in the housing 52. Any fuel fed into the fuel metering pump 46 which leaks between the bushing 76 and the plunger rod 74 is returned to the vapor separator 44 via the line 48, FIG. 4. Surrounding the plunger rod 74 above the bushing 76 are a spacer 78, a quad ring 82 and a retainer 84. A large diameter piston 86 is fixed to the top of each plunger rod 74 and is biased outwardly in a piston chamber 88, FIG. 5, by a large compression spring 90. An annular seal 92 is provided between the piston 86 and the chamber 88. The top of each plunger rod 74 is provided with a spherical button cam 94, the height of which generally defines the distance each plunger rod 74 may travel.

Figure 2:
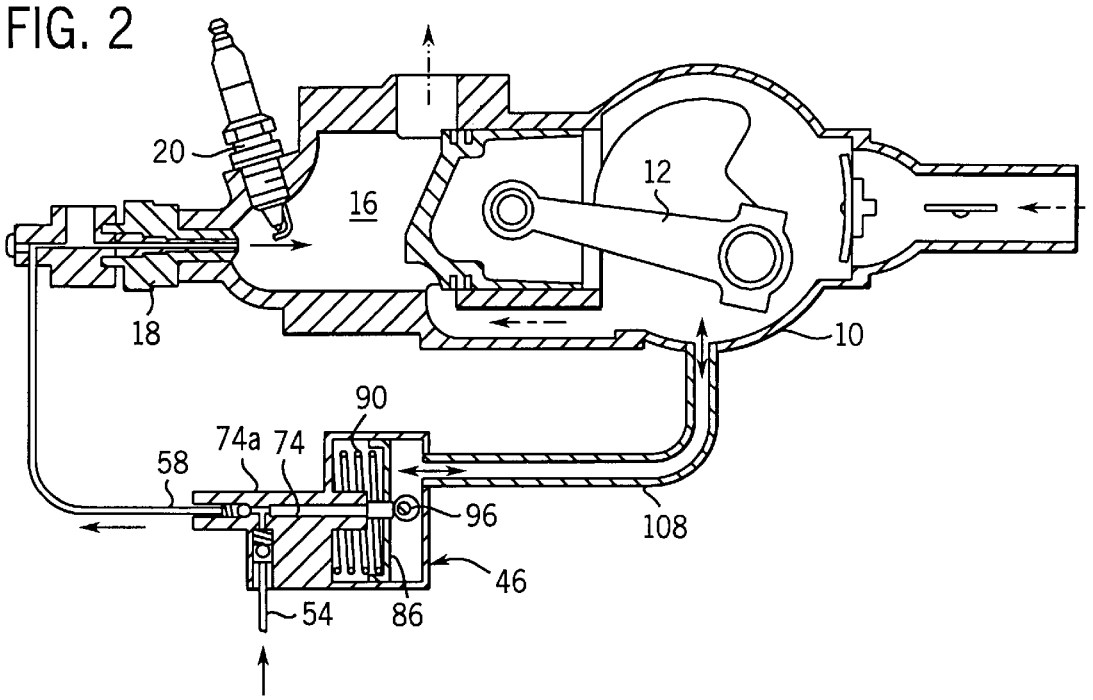
FIG. 2 is a diagrammatic view of a section of the fuel metering pump in relation to a crankcase and a combustion chamber of an internal combustion engine, having a single cylinder.

The volume of fuel metered from the fuel inlet 54 to the fuel outlet 58 is controlled by varying the stroke of the plunger rod 74. This is accomplished by means of a rotatable camshaft 96 supported by bearings 97 and disposed generally parallel to the fuel inlet 54 in a retainer plate assembly 98 attached to the housing 52. Illustrated in cross-section in FIG. 5, the camshaft 96 eccentrically carries a separate cam 100 engageable with the button cam 94 on each plunger rod 74 used in the fuel metering pump 46. One end 102, FIG. 4, of the camshaft 96 is connected to a throttle position indicator 104 input by the throttle position sensor 28 and supported by a bracket 105. Operatively connected to the end of the camshaft 96 is a throttle lever 106 which is connected by the throttle linkage 50 in order to receive or input driver demand. As illustrated in FIG. 2, the crankcase 10 is placed in communication with a relatively large upper surface of a piston 86 by a line 108 which carries crankcase pulses used to move the plunger rod 74 in chamber 71 between the fuel inlet 54 and fuel outlet 58 so that a prescribed amount of fuel may be delivered at an elevated pressure to each fuel injector 18. This result is attained by a relatively low pressure (e.g. 3.5 to 5 psi) from crankcase 10 being applied via line 108 to the large upper surface area of the piston 86 which results in fuel being forced out at a relatively high pressure (e.g. 80+ psi) in a metered volume 71 defined by the small diameter bottom 74*a* of the plunger rod 74. By rotating the camshaft 96, the plunger rod stroke is varied so as to regulate the fuel accordingly.

In accordance with the invention, each cam 100 is ground at an angle or tapered in the direction of the longitudinal axis of the camshaft 96 preferably with a frustoconical shape, FIG. 4. That is, cam 100 preferably has a large diameter end 100*a* tapering to a small diameter end 100*b*. Another end 110 of the camshaft 96 opposite the throttle linkage 50 is placed directly against the end of a motive shaft 112 of a linearly movable stepper motor 114 mounted in a sealed enclosure 115 directly to the housing 52. A horizontal bracket 115*a* attached to the retainer plate assembly 98 is used to support the motor 114 and enclosure 115. A preload spring 116 surrounding the camshaft 96 and extending between bracket 105 and a receiver 117 acts on an enlarged portion 99 of camshaft 96 and keeps the camshaft 96 in contact with the stepper motor shaft 112. As a result of this structure, movement of the stepper motor 114 as dictated by the ECM 30 will cause the rotatable camshaft 96 to be slid to the left in an axial direction (i.e. along the longitudinal axis of the camshaft 96) so that the button cam 94 is moved to a different point on the tapered surface of the frustoconical cam 100 thereby further moving the plunger rod 74 accordingly to vary fuel quantity. This allows the stepper motor 114 to trim the fueling level to the exact requirements for any throttle position, especially those away from idle.

FIGS. 6 and 7 represent a situation when the engine is off and where the camshaft 96 is at rest so that the end 100*a* of the cam 100 forces the plunger rod 74 and piston 86 downwardly against the force of spring 90. This positions plunger rod bottom 74*a* at a position in chamber 71 spaced from the inlet 69 so that fuel will flow at a low pressure of approximately 10–20 psi from fuel pump 42 to the fuel inlet 54 through the inlet check valve 68, inlet 69, chamber 71, and channel 70. The outlet check valve 72 remains seated against channel 70 and prevents further flow until the fuel pressure reaches a predetermined cracking value, typically about 42 psi.

FIG. 8 portrays what happens when the engine is started and throttle linkage 50 and throttle lever 106 are moved so as to rotate camshaft 96 in the direction of the arrow A. With the rotation of the crankshaft, a negative pulse delivered through line 108 in combination with the bias provided by spring 90 moves piston 86 and plunger rod 74 upwardly as camshaft 100 is rotated. As the crankshaft continues to rotate, a positive pulse delivered through line 108 will force piston 86 and plunger rod 74 downwardly against spring 90, and plunger rod bottom 74*a* moves downwardly through chamber 71 and covers inlet 69. This downward motion has the effect of metering or squirting the fuel in channel 70 at a relatively high pressure which will "crack" or open the outlet check valve 72 and push the fuel through outlet 58 at an elevated pressure and in a predetermined quantity governed by the volume of chamber 71 based upon the stroke of the plunger rod 74. The plunger rod 74 expels fuel at a high pressure achieved through the well known principle of pressure area differential between the piston 86 and the plunger rod 74. For example, if the surface area at the top of the piston 86 is approximately two square inches and the crankcase pressure applied through line 108 is about 4.0–4.5 psi, the total force applied to the top of piston 86 is about 8–9 lbs. At the bottom 74*a* of the plunger rod 74 having a typical surface area of 0.1 square inch, the pressure is:

$$8\text{–}9 \text{ lbs.}/0.1 \text{ in}^2$$

or 80–90 psi, which is applied by the downstroked plunger rod 74 to the low pressure fuel in chamber 71 at inlet 69 and channel 70 in order that the desired high pressure fuel is delivered through outlet 58 at 80+ psi and flows to fuel injector 18 in combustion chamber 16 where an air-fuel mixture is ignited by spark plug 20. It should be understood that the positive pulse from rotation of the crankshaft provides the injection pressure. The check valves 68 and 72 control fuel flow and direction.

FIGS. 10 and 11 next show the stepper motor 112 responding to a signal from the ECM 30 once the engine has proceeded, for instance, beyond idle conditions. In order to desirably trim the fueling level for any throttle position, the stepper motor shaft 112 moves axially outward to slide camshaft 96 in the direction of the arrow B. This has the effect of progressively moving tapered cam 100 along button cam 94 so as to gradually allow the raising of piston 86 and plunger rod 74 assisted by a negative pulse from the crankcase 10 and spring 90. Fuel can then be properly metered according to the particular throttle conditions until an alternating positive pulse through line 108 causes the piston 86 and plunger rod 74 to move downwardly for injection to that particular cylinder as shown in FIG. 12.

One main benefit of this assembly is that the stepper motor 114 can react faster than with previous external levers attached to the camshaft 96, thus providing better running quality and driveability. Another benefit is realized in that many cylinders may be controlled without increasing the load on the stepper motor 114 as much as with an external linkage. This is because of the prior art's reliance on the stepper motor working against a strong throttle return spring. Such linkage has been eliminated by the present invention so that loads can be decreased and speeds can be increased. With the mounting of the stepper motor 114 according to the present invention, the stepper shaft 112 is sealed from dirt and corrosion. This further increases the reliability and durability of the stepper motor 114.

It should be understood that the present invention enables exceptional idle stability and control in addition to enrichment of the fuel mixture for quick starting regardless of the temperature and rapid acceleration or high load situations. It should also be appreciated that the connection of the camshaft 96 to the throttle linkage 50 could be eliminated with the stepper motor 114 solely controlling the fueling. A sensor at the throttle 14 could relay driver demand electrically.

The present invention distinguishes over prior art fuel metering pumps by tapering the shape of each cam 100 on camshaft 96 so that each cam 100 may rotate and slide against the respective button cam 94 to vary the stroke of the plunger rod 74 and thereby provide different fueling levels for different speed and load conditions. The present invention further differs from the prior art by positioning the stepper motor shaft 112 directly against an end of the camshaft 96 rather than as part of a high load rotating lever connected with the throttle linkage 50.

While the invention has been described with reference to a preferred embodiment, those skilled in the art will appreciate that certain substitutions, alterations and omissions may be made without departing from the spirit thereof. Accordingly, the foregoing description is meant to be exemplary only, and should not be deemed limitative on the scope of the invention set forth with following claims.

I claim:

1. A fuel metering pump assembly for delivering fuel to a combustion chamber of an internal combustion engine having a crankcase, a throttle and at least one cylinder, the assembly comprising a housing having a fuel inlet and a fuel outlet, a metering arrangement disposed in the housing between the fuel inlet and the fuel outlet and having a first plunger rod movable in a chamber between the fuel inlet and the fuel outlet to control injection of fuel therefrom, a camshaft having a cam nonrotatably and nontranslationally fixed thereto, said camshaft extending along an axis and being translational therealong and rotatable thereabout, said cam engaging said first plunger rod to control the stroke thereof, rotation of said camshaft being responsive to said throttle, translation of said camshaft being responsive to speed of said engine, a second plunger rod extending along an axis perpendicular to the axis of said first plunger rod and coincident with the translational axis of said camshaft, said second plunger rod engaging an end of said camshaft to effect said translation of the latter, wherein said camshaft has distally opposite ends and said second plunger rod engages one of said distally opposite ends, and comprising throttle linkage engaging the other of said distally opposite ends to effect said rotation of said camshaft, and a coupling in said camshaft allowing translational movement of said one distally opposite end of said camshaft and said cam toward said other distally opposite end of said camshaft without said translational movement of said other distally opposite end of said camshaft, and providing rotation of said one distally opposite end of said camshaft and said cam upon rotation of said other distally opposite end of said camshaft.

* * * * *